US006450497B1

(12) United States Patent
Bialler et al.

(10) Patent No.: US 6,450,497 B1
(45) Date of Patent: Sep. 17, 2002

(54) MAGNETIC TABLE TOP GAME

(76) Inventors: Valeri Villievich Bialler, 93 Katerina Ave., Thornhill, Ontario (CA), L4J 8H4; Mikhail Arkadievich Rodionov, 499 Hounslow Ave., Toronto, Ontario (CA), M2R 1J1; Michael Semion Elent, 8 Brownridge, Thornhill, Ontario (CA), L4J 7X6; Felix Semion Elent, 91 Townsgate Drive, Thornhill, Ontario (CA), L4J 8E8; Fred Gordon Bates, 74 Westchester Drive, Oakville, Ontario (CA), L6H 6H8; Richard Peter Fast, P.O. Box 60059, Oakville, Ontario (CA), L6M 2S0

( * ) Notice: Subject to any disclaimer, the term of this patent is extended or adjusted under 35 U.S.C. 154(b) by 0 days.

(21) Appl. No.: 09/716,125

(22) Filed: Nov. 9, 2000

(30) Foreign Application Priority Data

Jan. 5, 2000 (CA) ..... 2293914

(51) Int. Cl.[7] ..... A63F 7/06

(52) U.S. Cl. ..... 273/108.1; 273/108.51; 273/126.4; 273/119 A

(58) Field of Search ..... 273/126 R, 126 A, 273/108, 118 A, 119 A, 108.1, 108.5, 108.51, 108.55, 108.56

(56) References Cited

U.S. PATENT DOCUMENTS

| | | | | |
|---|---|---|---|---|
| 2,716,028 A | * | 8/1955 | Yaeger | 273/108.51 |
| 3,976,296 A | * | 8/1976 | Smith | 273/108.1 |
| 4,192,508 A | * | 3/1980 | Livick | 273/118 A |
| 5,016,878 A | * | 5/1991 | Hay et al. | 273/108.51 |
| 5,275,401 A | * | 1/1994 | Llorens | 273/108.51 |
| 6,189,885 B1 | * | 2/2001 | Hamot | 273/108.1 |

FOREIGN PATENT DOCUMENTS

| | | | |
|---|---|---|---|
| DE | 2609458 | * | 9/1977 |
| DE | 3046136 | * | 7/1982 |
| FR | 2668713 | * | 5/1992 |

* cited by examiner

*Primary Examiner*—Raleigh W. Chiu
(74) *Attorney, Agent, or Firm*—Elias C. Borges

(57) ABSTRACT

A magnetic table game is disclosed wherein gaming pieces are movably mounted to a substantially non-magnetic playing surface of a game by a magnetic coupling device. The coupling device comprises a base mounted to the gaming piece, the base having a housing, a first and second magnet and a first support element positioned between the first and second magnets and further positioned to support the base on the surface. The base is held on surface by a magnetic coupling positioned on the opposite side of the surface. The magnetic coupling has a housing, a first and second magnet and a second support element positioned between the first and second magnets of the magnetic coupling and further positioned to support the base on the surface. The housings and the support members of the base and magnetic coupling are configured to position the magnets of the base in close proximity to the magnets of the magnetic coupling when the base and magnetic coupling are mounted to each other on opposite sides of the surface. The support members are made of a low friction material and are rotatably mounted to their respective housings by bearings. The gaming pieces are manipulated by moving the magnetic couplings via long lever arms which are operatively coupled to the magnetic couplings by gear drives. The gear drives convert the torsion of the lever arms into the rotation of the magnetic couplings, which in turn cause a corresponding rotation of the corresponding player piece.

17 Claims, 4 Drawing Sheets

MAGNETIC TABLE TOP GAME

FIELD OF THE INVENTION

The invention relates generally to magnetic games and in particular to magnetic table top or magnetic stand alone sports games.

BACKGROUND OF THE INVENTION

Table top games, such as table top hockey games, have been know for some time. These table top games generally consist of a playing board shaped to resemble a hockey arena or the like and several mechanically operated gaming pieces which are movably attached to the playing board. The gaming pieces are generally controlled by long lever arms which are coupled to the gaming pieces by a gear mechanism positioned beneath the gaming board. A player may move the gaming piece along the board by pulling or pushing the lever arm. The player may also rotate the gaming piece by twisting the lever arm. The gaming pieces are generally mounted to the gaming board along elongated slots, which help guide the playing pieces along the board, and at the same time, permit a mechanical connection between the gear mechanism and the gaming piece. Rotating the gaming piece is an important aspect of the game since it permits the player to manipulate the gaming piece to permit the piece to shoot the ball, puck or similar object.

Traditional table top games are very popular, however, the elongated slots associated with these traditional games are a nuisance. Firstly, the addition of elongated slots does not permit the use of forced air levitation of the puck. Furthermore, the mechanical connection between the gearing mechanism and the player piece through the slot makes it difficult to remove gaming pieces to simulate penalty situations. Finally, the elongated slots detract from the realism of the game play. Therefore, attempts have been made to provide gaming boards having magnetically controlled playing pieces. Existing magnetic table games utilize magnetic control systems consisting of magnetic gaming pieces which are manipulated by magnetic lever arms. The lever arms are provided with a magnet at one end which are used to magnetically couple the magnetic playing piece located on the opposite side of the playing surface. The magnets used in this system must be sufficiently strong to keep the gaming pieces on the playing surface. As the user pulls or pushes the lever arm, the magnetic playing piece is dragged across the playing surface. Unfortunately, prior magnetically operated table top games do not provide an optimum balance between the magnetic forces keeping the playing pieces on the playing surface and the force required by the user to manipulate the lever arm. If the magnetic forces are increased to ensure the playing pieces are securely held on the playing surface, then it will be very difficult to move the pieces because of the increased friction between the playing piece or lever arm and the playing surface. Furthermore, if the magnetic forces are high, then it will be very difficult for small children to use the game because they will not have the strength to move the gaming pieces. If the magnetic forces are decreased, then it will be difficult to accurately control the pieces. There remains a need for a table top magnetic board game which is easy to play and economical to construct.

SUMMARY OF THE INVENTION

The invention is a device for movably coupling a gaming piece to a substantially non-magnetic playing surface of a game. The coupling device comprises a base mounted to the gaming piece, the base having a housing, a first and second magnet and a first support element positioned between the first and second magnets and further positioned to support the base on the surface. The base is held on surface by a magnetic coupling positioned on the opposite side of the surface. The magnetic coupling has a housing, a first and second magnet and a second support element positioned between the first and second magnets of the magnetic coupling and further positioned to support the base on the surface. The housings and the support members of the base and magnetic coupling are configured to position the magnets of the base in close proximity to the magnets of the magnetic coupling when the base and magnetic coupling are mounted to each other on opposite sides of the surface. The gaming pieces are manipulated by moving the magnetic couplings via long lever arms which are operatively coupled to the magnetic couplings.

DETAILED DESCRIPTION OF THE INVENTION

Figure 1:
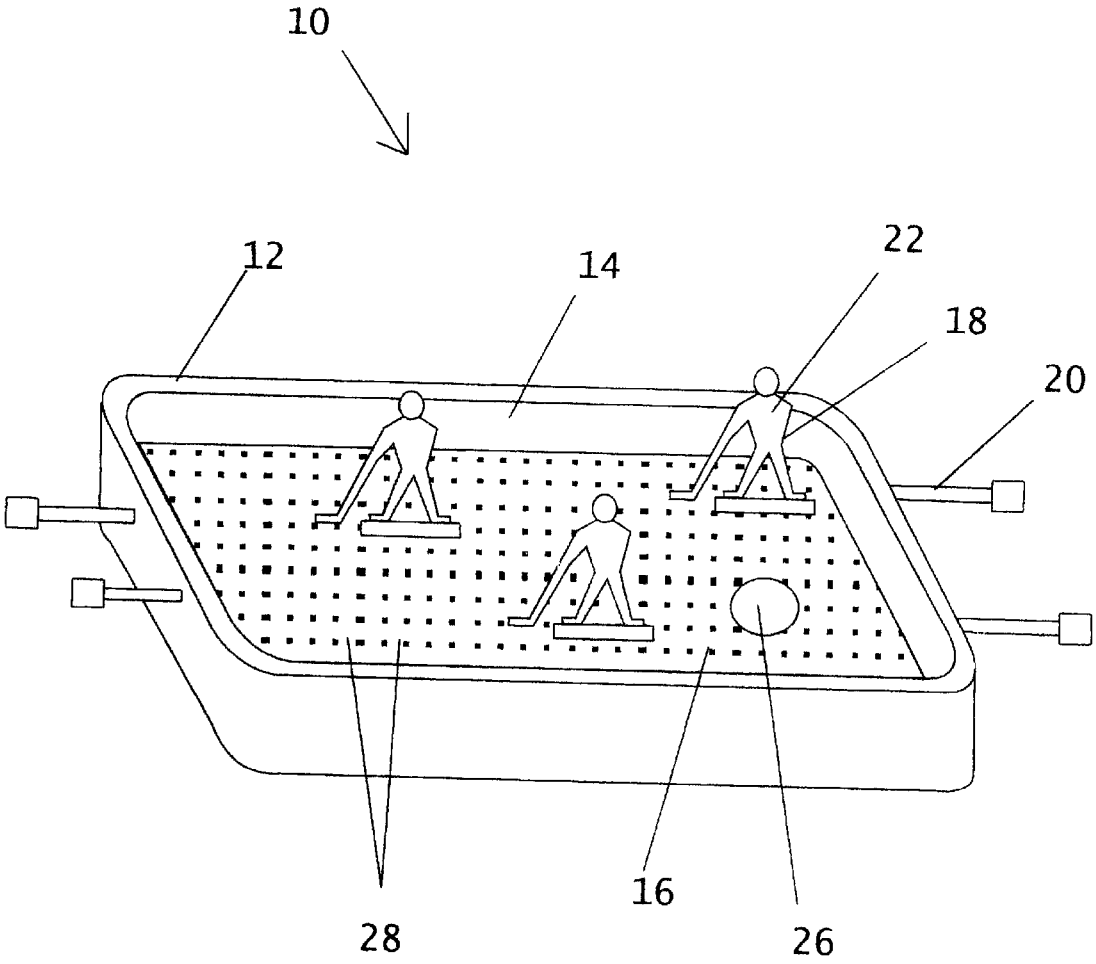
FIG. 1 is a perspective view, of the present invention.

Referring firstly to FIG. 1, a gaming board made in accordance with the present invention, shown generally as item 10, comprises game board 12 having sides 14, playing surface 16, lever arms 20 and gaming pieces 18. Gaming pieces 18 in turn comprise game figure 22 mounted on top of magnetic base 24. Lever arms 20 are mechanically coupled to gaming pieces 18 via base 24 such that a game player may manipulate puck 26 by moving lever arms 20. Playing surface 16 may be provided with perforations 28 to permit compressed air to flow through the board to support puck 26 on a cushion of air.

Figure 2:
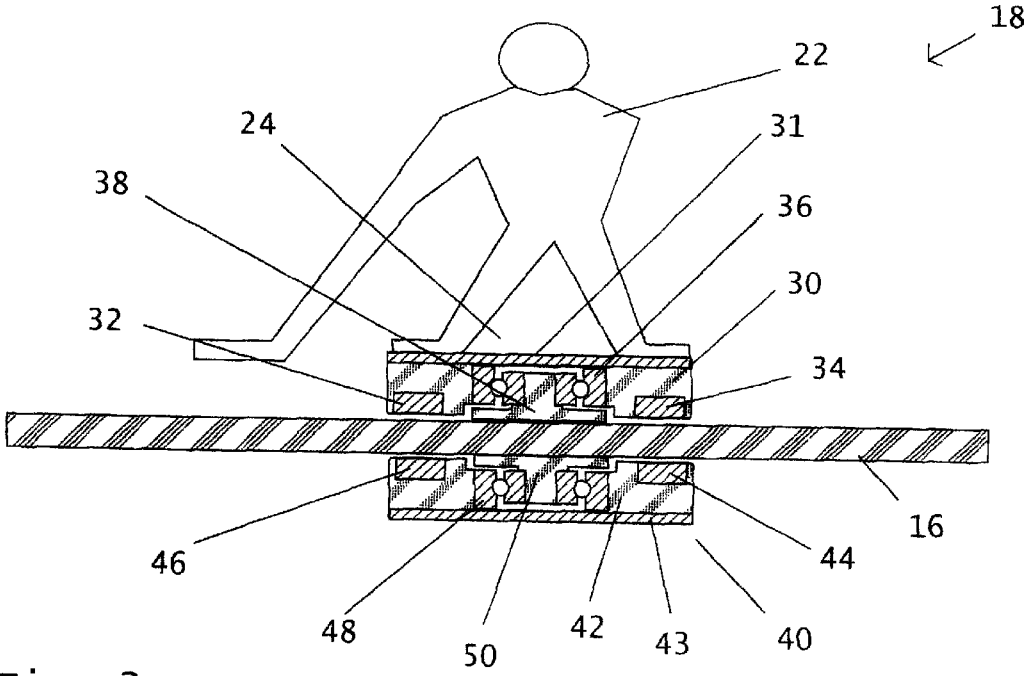
FIG. 2 is a side view of a gaming piece of the present invention partly in cross section.

Referring now to FIG. 2, gaming piece 18 comprises figurine 22 generally in the shape of the desired player, such as a hockey, soccer, baseball, golf or any other desired player. Figurine 22 is rigidly mounted onto base 24. Base 24 comprises housing 30, magnets 32 and 34 rigidly mounted within the housing, bearing 36 mounted to the housing at a position between the magnets, plate 31 and support member 38 mounted to the bearing. Housing 30 is supported on top of playing surface 16 by support member 38. Support member 38 is rotatably mounted to housing 30 via bearing 36. Bearing 36 is a rotatable low friction bearing which is mounted to both support member 38 and housing 30 permitting the housing to spin easily relative to support member 38.

Mounted below playing surface 16 is magnetic coupling mechanism 40. Magnetic coupling mechanism 40 comprises housing 42, magnets 44 and 46, bearing 48 mounted to the housing between the magnets, plate 43 and support member 50 mounted to the bearing. Housing 42 is separated from player surface 16 by support member 50, which in turn is mounted to bearing 48. Bearing 48 is a rotatable low friction bearing which permits housing 40 to spin easily relative to support member 50. Support members 38 and 50 are disks of low friction material such as teflon or some other low friction material and permit base 24 and magnetic coupling mechanism 40 to move along playing surface 16 with relative ease.

Base 24 is positioned opposite magnetic coupling mechanism 40 such that complementary magnetic pairs 32/46 and 34/44 are in magnetic contact with each other. If magnets 32 and 34 are sufficiently strong, then magnets 44 and 46 may be replaced with iron or some other magnetic material. Alternatively, magnets 32 and 34 may be replaced with iron if magnets 44 and 46 are sufficiently strong. To maximize the strength of the magnetic flux between base 24 and magnetic coupling 40, then complementary magnetic pairs 32/46 and 34/44 should be used. Other measures ensure a strong magnetic connection; for example, housings 30 and 42 are made of a non-magnetic material such as plastic or aluminum in order to maximize the magnetic flux between complementary magnetic pairs 32/46 and 34/44. Furthermore, plates 31 and 43 are made of a magnetic material such as iron or steel, and also help maximize the magnetic flux between complementary magnetic pairs 32/46 and 34/44. The use of non-magnetic materials for housings 30 and 42 together with magnetic materials for plates 31 and 43 create a strong magnetic coupling between base 24 and magnetic coupling 40. Being magnetically coupled in this way, rotation of magnetic coupling 40 causes a corresponding rotation in base 24. Bearings 48 and 36 permit magnetic coupling 40 and base 24 to rotate freely with little friction since complementary magnets 32, 46, 34 and 44 do not contact playing surface 16. Bearings 48 and 36 permit magnetic coupling 40 to rotate base 24 with little player effort.

Figure 3:
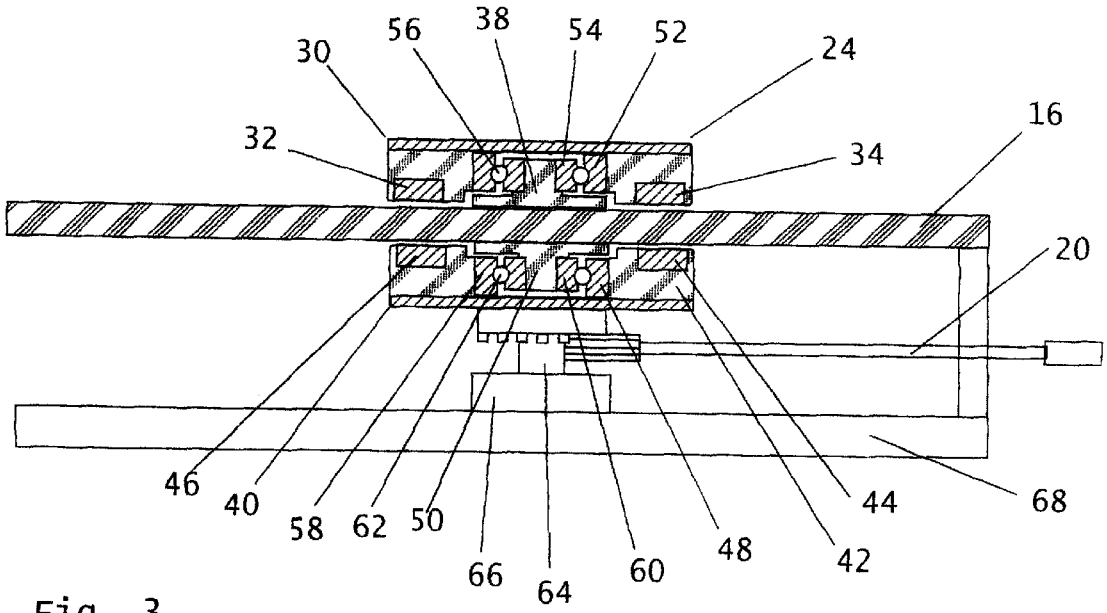
FIG. 3 is a side view of the present invention showing the gaming piece in relation to the board and in relation to the gaming piece control unit.
Figure 6:
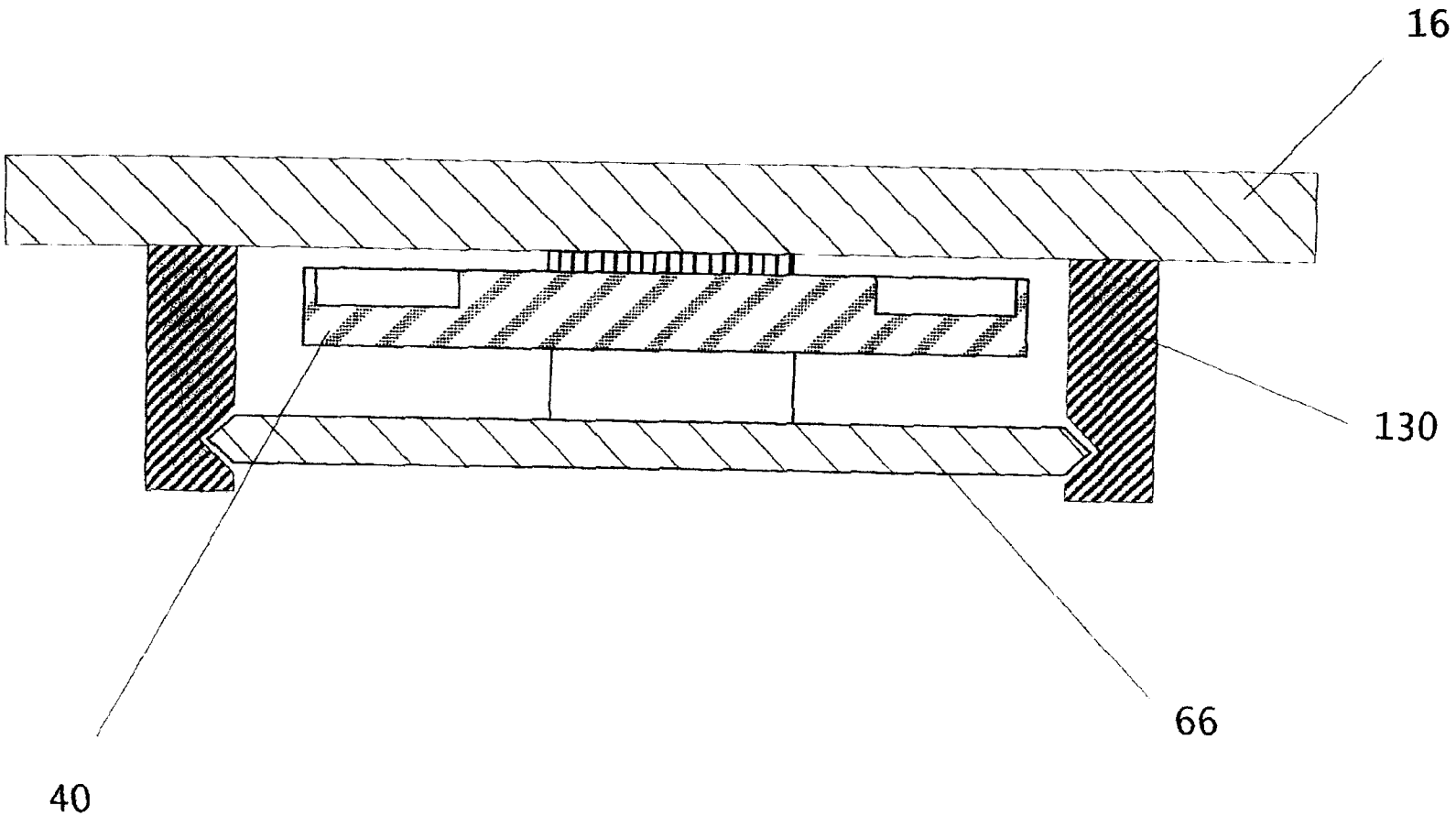
FIG. 6 is a side view, partly in cross section, of yet another alternate embodiment of the present invention.

Referring now to FIG. 3, bearing 36 preferably comprises a bearing having outer member 36, inner member 54 and ball bearings 56. Ball bearings 56 permit outer member 36 to spin freely relative to inner member 54. Housing 30 is attached to outer member 36, while support member 38 is attached to inner member 54. Likewise, torsion member 48 comprises a bearing having outer member 58, inner member 60 and ball bearings 62. Housing 42 is attached to outer member 58 while support member 50 is attached to inner member 60. To permit a user to control the movement of base 24, magnetic coupling mechanism 40 is coupled to gear drive 64, which in turn is mechanically coupled to lever arm 20. Gear drive 64 translates the twisting motion of lever arm 20 into a corresponding rotation of magnetic coupling mechanism 40. Several suitable gear drive mechanisms for translating a twisting motion of a lever arm into a corresponding rotation are well known in the art. To permit magnetic coupling mechanism 40 to move smoothly beneath playing surface 16, the magnetic coupling mechanism may be mounted to guide 66 which in turn is mounted to base 68. Alternatively, as seen in FIG. 6, guide 66 may be mounted within elongated housings 130 which are in turn mounted to the underside of playing surface 16.

Figure 4:
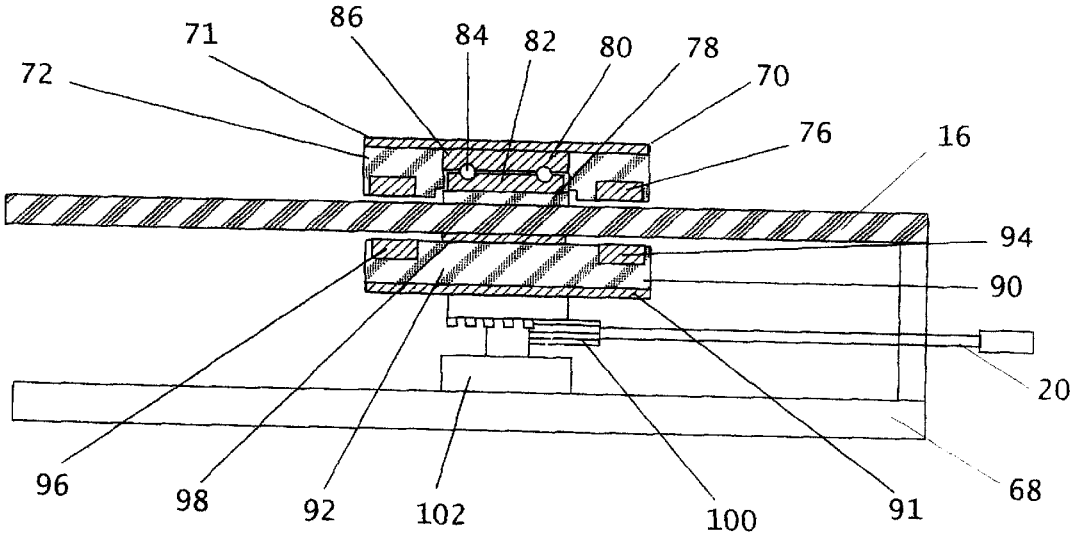
FIG. 4 is a side view, partly in cross section, of an alternate embodiment of the present invention.

The bearing may comprises any bearing type mechanism, with or without ball bearings, which permits easy rotation. For example, in FIG. 4 an alternate embodiment of the invention is shown wherein base 70 uses a bearing 80 which comprises a thrust bearing having central portion 82, outer portion 86 and ball bearings 84. Outer portion 86 is physically connected to housing 72 which in turn house magnets 74 and 76. Central portion 82 is physically connected to support member 78. In this arrangement, the thrust bearing permits very easy rotation of base 70 even if the base is pressed against playing surface 16 with considerable force. Corresponding magnetic coupling mechanism 90 may comprise housing 92, magnets 94 and 96 and support member 98. If support member 98 is sufficiently slippery, then there may be no need for a separate low friction bearing. Plates 71 and 91 are provided on housings 72 and 92 respectively. To maximize the magnetic flux between the magnets, housings 72 and 92 are made of a non-magnetic material while plates 71 and 91 are made of a magnetic material. As with the earlier embodiment, magnetic coupling mechanism 90 is operatively coupled to lever arm 20 via gear mechanism 100, which in turn may be mounted to base 68 via guide 102. As can be seen from the embodiment shown in FIG. 4, the base mechanism does not have to be identical to the magnetic coupling mechanism.

Figure 5:
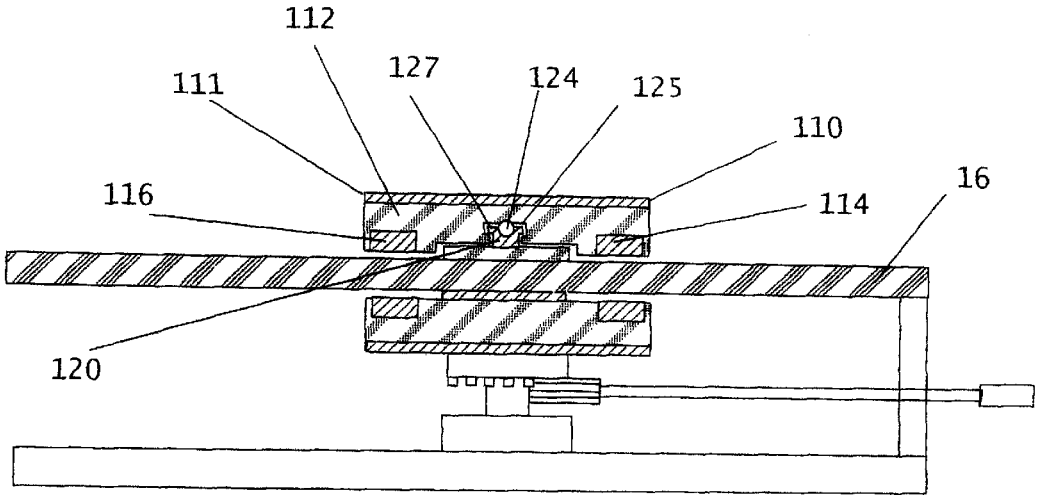
FIG. 5 is a side view, partly in cross section, of yet another alternate embodiment of the present invention.

Referring now to FIG. 5, yet another embodiment of the present invention is shown wherein base 110 comprises housing 112, magnets 114 and 116 and bearing 122. Bearing 122 comprises a swivel joint formed from central element 120 having ball bearing 124 which is retained in socket 125 of housing 112. Central element 120 is physically connected to support member 118. Central element 120 is restrained in socket 125 via ridges 127. While this type of bearing is effective, it is possible to do away with ball bearing 124 if central element 120 is made of a low friction material such as teflon. Other possible bearing arrangements may be used.

Referring now back to FIGS. 2 and 3, to operate the gaming piece, a player simply manipulates lever arm 20. By twisting lever arm 20, magnetic coupling mechanism 40 is made to rotate which in turn causes base 24 to rotate. Since torsion elements 36 and 48 are centrally disposed relative to magnets 32/34 and 44/46, the rotation of base 24 and magnetic coupling mechanism 40 is achieved with a minimum amount of torque applied to lever arm 20. This permits small children to manipulate the gaming pieces and play the game. Furthermore, since support members 38 and 50 are centrally disposed relative to magnet pairs 32/34 and 44/46, respectively, the magnet pairs are kept in close alignment even if base 24 and magnetic coupling mechanism 40 are rapidly moved along playing surface 16. Furthermore, the central location of the support members relative to the magnet pairs also minimizes the surface area in contact between the support members and playing surface 16, which in turr permits the gaming pieces to be moved with a minimum of force applied to the lever arms 20.

Specific embodiments of the present invention have been disclosed; however, several variations of the disclosed embodiments could be envisioned as within the scope of this invention. It is to be understood that the present invention is not limited to the embodiments described above, but encompasses any and all embodiments within the scope of the following claims.

What is claimed is:

1. A device for movably coupling a gaming piece to a substantially non-magnetic surface having opposite sides, said device comprising;

(a) a base mountable to the gaming piece, the base comprising a housing, a first and second magnet and a first support element positioned between the first and second magnets, the first support element dimensioned and configured to support the base on one side of the surface, (b) a magnetic coupling positioned on an opposite side of the surface relative to the base, said magnetic coupling comprising a housing, a first and second magnet and a second support element positioned between the first and second magnets of the magnetic coupling, the second support element dimensioned and configured to position the magnetic coupling on the opposite side of the surface, (c) the housings and the support members of the base and magnetic coupling configured to position the magnets of the base in close proximity to the magnets of the magnetic coupling when the base and magnetic coupling are mounted to each other on opposite sides of the surface;

(d) the support members being made of a low friction material, and (e) both of the support members being rotatably mounted to their respective housings.

2. A device as defined in claim 1 wherein the support members are rotatably mounted to their respective housings by low friction bearings.

3. A device for movably coupling a gaming piece to a substantially non-magnetic surface having opposite sides, said device comprising;

(a) a base mountable to the gaming piece, the base comprising a housing, a first and second magnet and a first support element positioned between the first and second magnets, the first support element dimensioned and configured to support the base on one side of the surface, (b) a magnetic coupling positioned on an opposite side of the surface relative to the base, said magnetic coupling comprising a housing, a first and second magnet and a second support element positioned between the first and second magnets of the magnetic coupling, the second support element dimensioned and configured to position the magnetic coupling on the opposite side of the surface, (c) the housings and the support members of the base and magnetic coupling configured to position the magnets of the base in close proximity to the magnets of the magnetic coupling when the base and magnetic coupling are mounted to each other on opposite sides of the surface, and (d) wherein at least one of the coupling and the base further comprises a plate, the plate being made of a magnetic material, the plate being mounted to the housing and positioned relative to the magnets to maximize the magnetic flux between the magnets of the base and the magnets of the magnetic coupling.

4. A device as defined in claim 3 wherein both the base and the coupling have a plate mounted to their respective housings, each plate being made of a magnetic material and positioned relative to the magnets to maximize the magnetic flux between the magnets of the base and the magnets of the magnetic coupling.

5. A device as defined in claim 3 wherein at least one of the first and second support members are rotatably mounted to its respective housing.

6. A device as defined in claim 3 wherein both the first and second support members are rotatably mounted to their respective housings.

7. A device as defined in claim 6 wherein the first and second support members are each rotatably mounted to their respective housings by a low friction bearing.

8. A game comprising;

(a) a game housing supporting a non-magnetic playing surface having opposite sides, (b) a plurality of magnetic game pieces, each piece having a base mounted to the gaming piece, the base comprising a housing, a first and second magnet and a first support member made of a low friction material positioned between the first and second magnets, said first support member dimensioned and configured to support the base on one side of the playing surface, said first support member being rotatably mounted to the housing of the base, (c) a plurality of magnetic couplings on the opposite side of the playing surface for movably coupling the game pieces to the surface, each magnetic coupling comprising a housing, a first and second magnet and a second support member made of a low friction material positioned between the first and second magnets of the magnetic coupling, said second support member dimensioned and configured to position the magnetic coupling on said opposite side of the surface, said second support member being rotatably mounted to the housing of the coupling, (d) the housings and the support members of the bases and magnetic couplings configured to position the magnets of each base in close proximity to the magnets of the corresponding magnetic coupling when the base and magnetic coupling are mounted to each other on opposite sides of the playing surface, (e) a plurality of lever arms for controlling the game pieces, each lever arm operatively coupled to a particular magnetic coupling of a respective game piece, the lever arm moving the game piece by creating a corresponding movement of the magnetic coupling.

9. A device as defined in claim 8 wherein the said support members are each rotatably mounted to their respective housings by a low friction bearing.

10. A device as defined in claim 9 wherein the bearing comprises a standard ball bearing mechanism with an internal sleeve, and external sleeve and a plurality of ball bearings mounted between the internal and external sleeves.

11. A device as defined in claim 10 wherein the bearing comprises a thrust bearing.

12. A device as defined in claim 10 wherein the bearing comprises a pivot bearing.

13. A device as defined in claim 8 further comprising a plate mounted to the housing the magnetic coupling, the plate being made of a magnetic material and positioned relative to the magnets to maximize the magnetic flux between the magnets of the base and the magnets of the magnetic coupling.

14. A device as defined in claim 13 further comprising a second plate mounted to the housing of the base, the second plate being made of a magnetic material and positioned relative to the magnets to maximize the magnetic flux between the magnets of the base and the magnets of the magnetic coupling.

15. A device as defined in claim 8 further comprising a guide for guiding the longitudinal motion of the magnetic couplings when the couplings are longitudinally moved by the lever arms.

16. A device as defined in claim 15 wherein said guide comprise a first member mounted to the gear drive and a second member mounted to the underside of the playing surface.

17. A device as defined in claim 15 wherein said guide comprises a first member mounted to the gear drive and a second member mounted to the game housing beneath the playing surface.

* * * * *